United States Patent [19]

Russo

[11] 3,940,900

[45] Mar. 2, 1976

[54] PANEL SUPPORTING FRAME ASSEMBLY

[75] Inventor: Adolph D. Russo, Beachwood, Ohio

[73] Assignee: Russo Ornamental Iron Products, Inc., Bedford Heights, Ohio

[22] Filed: Nov. 20, 1974

[21] Appl. No.: 525,393

[52] U.S. Cl. ..... 52/656; 49/504; 52/238; 52/465; 52/476; 52/758 H; 85/84

[51] Int. Cl.[2] ..... E04C 2/38

[58] Field of Search ..... 52/238–243, 52/455, 465, 475, 476, 501, 502, 627, 628, 656, 758 H; 160/381; 49/501, 504; 85/83, 84

[56] References Cited

UNITED STATES PATENTS

| | | | |
|---|---|---|---|
| 3,226,150 | 12/1965 | Menzer | 85/84 |
| 3,276,802 | 10/1966 | O'Brien | 52/758 H |
| 3,592,493 | 7/1971 | Goose | 52/656 |
| 3,642,310 | 2/1972 | Hudson | 52/656 |
| 3,798,863 | 3/1974 | Latson | 52/656 |
| 3,832,931 | 9/1974 | Talan | 85/84 X |
| 3,867,048 | 2/1975 | Endzweig | 52/758 H |

FOREIGN PATENTS OR APPLICATIONS

| | | | |
|---|---|---|---|
| 1,311,348 | 10/1962 | France | 52/239 |
| 1,188,837 | 4/1970 | United Kingdom | 52/475 |

*Primary Examiner*—J. Karl Bell
*Attorney, Agent, or Firm*—Meyer, Tilberry & Body

[57] ABSTRACT

A frame assembly is disclosed for supporting a panel which together with the frame provides a partition or divider structure. The frame assembly includes a pair of upright frame members of extruded aluminum and a pair of horizontal frame members of extruded aluminum. The upright members are provided with opposed pairs of polygonal openings therethrough, and the horizontal members include a tubular portion complementary in polygonal cross-section and dimension with respect to the openings in the upright members. Expandable fasteners of complementary cross-section are inserted through the openings and expanded to interconnect the horizontal and vertical members. The horizontal members include integral pairs of flanges providing opposed recesses for receiving corresponding edges of a panel supported by the frame assembly.

13 Claims, 4 Drawing Figures

FIG. 1
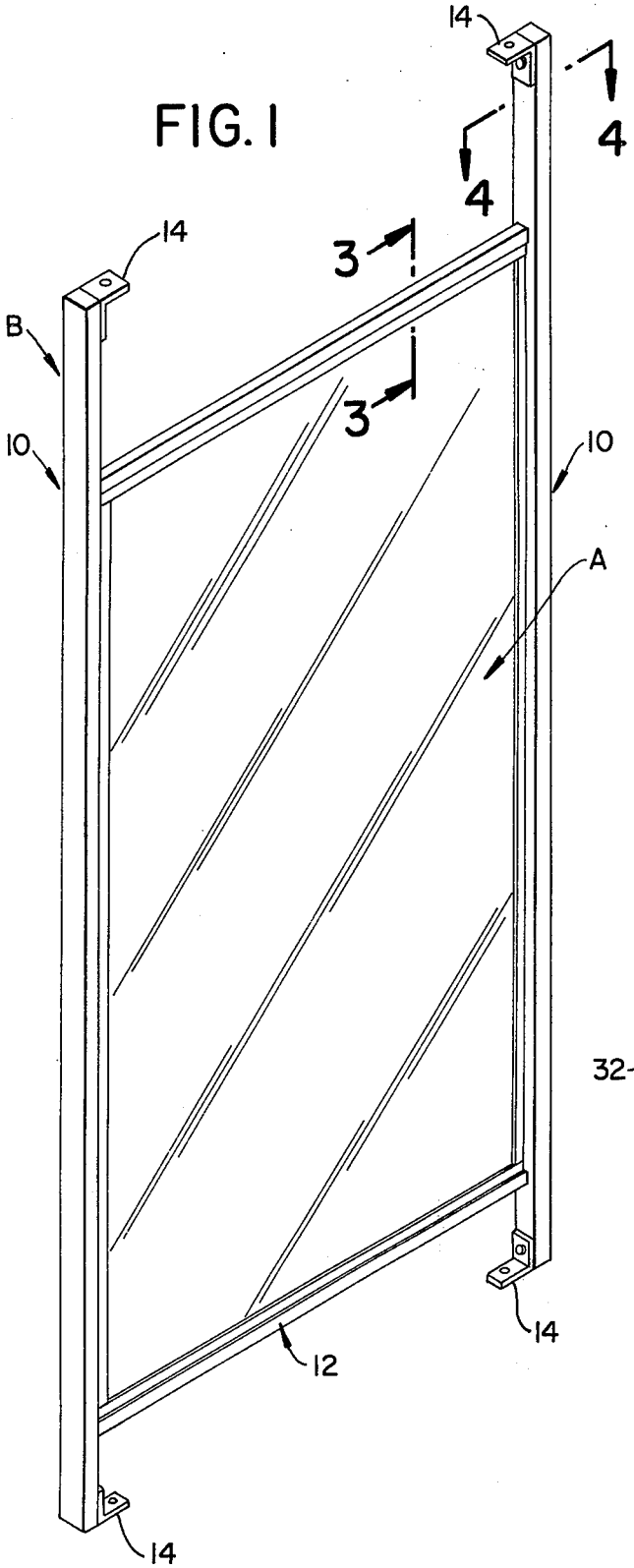
FIG. 3
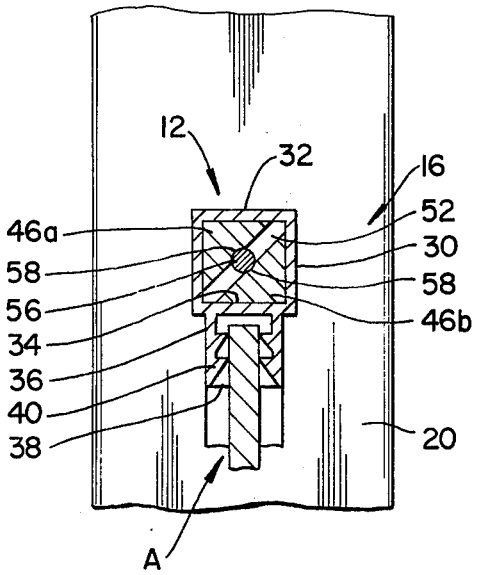
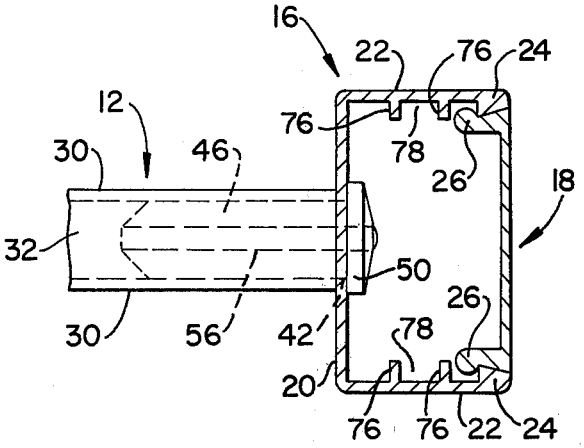
FIG. 4

PANEL SUPPORTING FRAME ASSEMBLY

The present invention relates to the art of partitions and, more particularly, to an improved frame assembly for supporting the panel of a partition or divider structure.

Partition or divider panel structures serve a wide variety of purposes including, for example, dividing office space into cubicles, separating adjacent areas of living quarters such as living room and dining areas, and dividing adjacent balcony areas in apartment buildings or the like for privacy purposes. A number of partition structures are available for these and other purposes including, for example, panels of synthetic plastic material or the like supported by frame structures which are mounted on and between support surfaces such as a floor and ceiling.

In connection with such framed panel partition structures heretofore provided, an extremely large number of different structural members and fasteners are required to complete the assembly thereof, whereby the cost of part fabrication and assembly thereof is very expensive. Often, for example, at least some of the frame members are tubular components of sheet metal construction and the fabrication thereof requires the bending, edge forming and edge joining to complete the tubular structure. Furthermore, such a frame member is often provided with brackets, U-shaped channels, or other structural components for receiving and supporting an edge of the framed panel. Such supporting components must of course be mounted on the frame member and such mounting is achieved by welding or the use of fasteners such as screws. This of course, adds to the cost of fabrication in that a large number of different members and fasteners must be provided and in that the assembly of the component parts is very time consuming.

Moreover, upon completion of the assembly of the component parts of framed panel partition structures heretofore provided, it is difficult and sometimes impossible to disassemble the components to replace or repair a broken or damaged part. Accordingly, it is often necessary to completely replace a partition structure as a result of damage to a component part thereof. Further, if disassembly is possible to enable part replacement, such disassembly is time consuming and thus expensive.

In accordance with the present invention, an improved frame assembly for supporting a partition or divider panel is provided by which the foregoing difficulties and others of such panel structures heretofore provided are avoided or overcome. In this respect, a frame assembly is provided which is comprised of a minimum number of component parts and fasteners. Moreover, the parts are structured and structurally interrelated to facilitate part production and assembly with minimum time and effort, and to provide a frame and panel assembly having structural integrity and an overall appearance which is pleasing to the eye.

More particularly, the panel frame assembly of the present invention is comprised of a first pair of parallel spaced apart frame members which are interconnected by a second pair of frame members extending therebetween. Aligned openings of polygonal cross-section are provided through the first pair of frame members, and the opposite ends of the second pair of frame members are provided with polygonal openings aligned with the corresponding pair of the openings through the first support members. Preferably, the openings are of complementary cross-sectional configuration and dimension, and the first and second pairs of frame members are interconnected by expandable fasteners extending through the openings in the first members and into the openings in the ends of the second pair of members. The expandable fasteners have portions disposed in the openings in the first and second frame members, and the fastener portions are of complementary cross-sectional configuration and dimension with respect to the openings. Accordingly, the frame members are interconnected against relative rotation therebetween with respect to the axes of the openings.

Importantly, in accordance with the present invention, the second frame members are each provided with a pair of integral longitudinally extending parallel flanges defining a panel edge receiving recess, and the recesses of the two members are disposed in parallel opposed relationship. Preferably, the second frame members are extruded aluminum tubes of square cross-section having the flanges on one of the walls of the tube. The tubular portion thus provides the polygonal openings for the second frame members. By providing for the panel receiving recesses to be defined by flanges integeral with the second frame members, the use of a separate structural componenet for this purpose is avoided together with the cost of fabrication and assembly thereof on the frame member. Further, the existence of a visible line of demarcation between two such assembled components is avoided, thus to enhance the appearance of the frame member and ultimately the framed panel structure.

In accordance with the preferred embodiment of the invention, the first frame members are also of extruded aluminum and are U-shaped channels disposed with the open sides thereof facing outwardly of the panel frame structure. The webs of the channels are provided with square openings through which expandable fasteners of square cross-section are inserted. An extruded aluminum cover plate is removably interengaged with each channel member to close the open side thereof. The cover plate advantageously hides the fasteners and thus enhances the appearance of the frame assembly. Moreover, the cover plate is removable to provide access to the fasteners should it become necessary or desirable to disassemble the framed panel structure for maintenance or replacement purposes. The opposite ends of the first frame members are provided with mounting brackets by which the completed frame and panel structure is adapted to be mounted between supporting surfaces such as a floor and ceiling. Such mounting brackets are also preferably extruded components.

Extrusion of the frame members, the covers for the first frame members, and the mounting brackets advantageously enables these components to be produced in indeterminate lengths which can be cut to desired lengths for a given panel frame assembly. This not only facilitates the fabrication process but also provides for uniformity of the components in appearance and dimension, thus to minimize free play between the frame components upon assembly thereof, obvious misalignment between the frame components due to errors in fabrication, and differences in appearance between one frame assembly and another.

It is accordingly an outstanding object of the present invention to provide an improved frame assembly for supporting a partition or divider panel member.

Another object of the present invention is the provision of a panel supporting frame structure comprised of a minimum number of different structural parts.

A further object of the present invention is the provision of an improved panel suppporting frame structure which is extremely simple to assemble and disassemble and which, when assembled, is structurally stable and pleasing in appearance.

Yet another object of the present invention is the provision of an improved panel supporting frame assembly in which the frame components are interengaged by expandable fasteners to prevent relative rotation therebetween and to enhance structural stability of the frame assembly.

Yet a further object of the present invention is the provision of an improved panel supporting frame assembly in which opposed frame members of the assembly are each of one piece construction including integral flanges defining panel edge receiving recesses.

Still another object of the present invention is the provision of a panel supporting frame assembly comprised of two pairs of extruded aluminum frame members, at least one of which pairs of members are of one piece construction, and which pairs of members are interconnected to define a rectangular frame unit adapted to support a panel member therebetween independent of any fasteners or structural components attached to the extruded members.

The foregoing objects, and others, will in part be obvious and in part pointed out more fully hereinafter in conjunction with the description of a preferred embodiment of the invention shown in the accompanying drawings in which:

FIG. 1 is a perspective view of a panel supporting frame assembly made in accordance with the present invention;

FIG. 3 is a cross-sectional view taken along line 3—3 in FIG. 1; and, FIG. 4 is a cross-sectional view taken along line 4—4 in FIG. 1.

Figure 2:
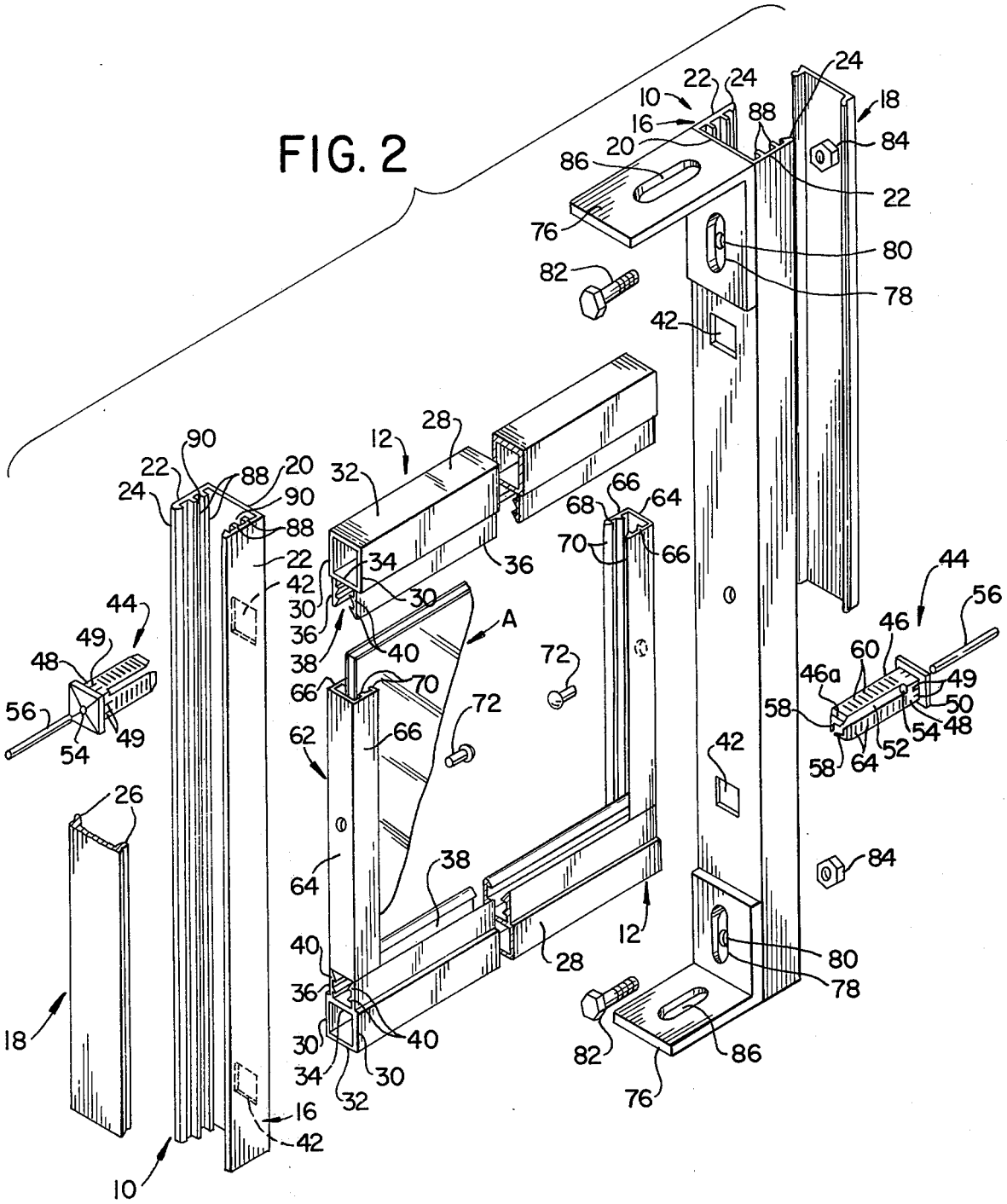
FIG. 2 is an exploded perspective view of the components of the frame assembly shown in FIG. 1.

Referring now in greater detail to the drawings wherein the showings are for the purpose of illustrating a preferred embodiment of the invention only and not for purposes of limiting the invention, a partition or divider structure is shown in FIG. 1 which is comprised of a panel member A and a frame assembly B. Frame assembly B, to be described more fully hereinafter, is comprised of a pair of upright frame members 10 laterally spaced apart and interconnected by horizontally extending upper and lower frame members 12. In the embodiment shown, the partition is adapted to be oriented in a vertical disposition and interconnected between spaced apart supporting surfaces such as the floor and ceiling of a room or the like and, accordingly, the upper and lower ends of frame members 10 are provided with mounting brackets 14 for this purpose. While a particular vertical spacing is shown between frame members 12, it will be appreciated that this spacing, as well as the spacing between frame members 10, will vary depending on the intended use for the partition or divider.

The structures of the frame members and the interconnections therebetween to define the frame assembly are show in detail in FIGS. 2–4 of the drawing. Referring to these Figures, upright frame members 10 are of identical construction and include a channel member 16 opening outwardly from the corresponding side of the assembly, and a cover member 18 which closes the open side of the channel as set forth more fully hereinafter. Preferably, channel member 16 and cover member 18 are aluminum extrusions. Each channel 16 includes a web 20 and a pair of flanges 22 extending along the side edges thereof. The outer ends of flanges 22 terminate in longitudinally extending inwardly directed projections 24 adapted to cooperably interengage with longitudinally extending projections 26 on cover plate 18 to releasably interengage the cover plate with the channel. Preferably, the resiliency of channel flanges 22 and the contours of projections 24 and 26 provides for the cover plate to be releaseably snap-locked in place across the open side of the channel.

The horizontal upper and lower frame members 12 are each of one piece construction and are of identical structure. In this respect, each of the frame members 12 includes a tubular portion 28 which is square in cross-section and includes an opposed pair of side walls 30 and opposed outer and inner walls 32 and 34, respectively. A pair of longitudinally extending flanges 36 extend inwardly of the frame structure from inner wall 34 of each tubular portion 28. Flanges 36 are parallel to one another and to walls 30 and are laterally spaced apart in the direction between walls 30 to define a panel edge receiving recess 38 which receives a corresponding marginal edge of panel A. The inner surface of each flange 36 includes longitudinally extending ribs 40 projecting inwardly with respect to the corresponding recess 38 to frictionally engage the opposite sides of panel A. Preferably, frame members 12 are defined by aluminum extrusions, whereby the identical structures thereof enables such a frame member to be produced in an intermediate length and then cut to provide the individual frame members.

The inner surfaces of walls 30, 32 and 34 of tubular portions 28 of frame members 12 define square openings extending therethrough. At locations corresponding to the points of engagement of the ends of frame members 12 with side frame members 10, webs 20 of channels 16 are provided with square openings 42 therethrough which correspond in cross-sectional dimension with the openings through tubular portions 28. Openings 42 are aligned with the opening into the corresponding end of tubular portion 28, and expandable fastener plugs 44 are introduced through openings 42 and into the corresponding end of tubular portion 28 to interengage frame members 10 and 12, as set forth more fully hereinafter.

Fastener plugs 44 preferably are malleable aluminum castings and each plug includes a portion 46 disposed in the corresponding end of tubular portion 28, and a portion 48 disposed in opening 42 in web 20. Plug portions 46 and 48 correspond in cross-sectional dimension and contour with the corresponding opening in which they are received. Accordingly, in the embodiment disclosed plug portions 46 and 48 are square in cross-section. Plug 44 further includes a head 50 which engages the outer surface of web 20 to limit the extent of plug insertion.

Plug portion 46 is divided into a pair of legs **46*a* and 46*b* by means of a slot 52 which extends diagonally through portion 46. Legs 46*a* and 46*b* are radially expandable with respect to the axis of the plug and, for this purpose the plug is provided with a longitudinally extending bore 54 adapted to receive a cylindrical steel drive pin 56. The portion of bore 54 extending through plug portion 48 and head 50 is of a diameter having a tight fit with pin 56, whereby the latter must be forceably driven into the bore, such as by a hammer. In the embodiment shown, the width of slot 52 between legs 46***a* and 46*b* is less than the diameter of pin 56, and the opposed inner faces of legs 46*a* and 46*b* are provided with longitudinally extending arcuate pin guiding recesses 58. The latter recesses taper inwardly of the fastener axis from the ends adjacent plug portion 48 toward the free ends of the fastener legs to provide for pin 56 to radially displace legs 46*a* and 46*b* when the pin is driven therebetween.

It will be appreciated from the foregoing description that an end of a frame member 12 is readily interconnected with a side member 10 by aligning tubular portion 28 with opening 42, inserting plug 44 through opening 42 and into tubular portion 28 until head 50 abuts web 20, and then driving pin 56 into the plug. The square contour of plug portion 48 cooperates with square opening 42 to prevent rotation of the plug about its axis relative to frame member 10. The cross-sectional dimensions of plug portion 48 and opening 42 preferably provide for a tight fit therebetween, and plug portion 48 is provided with longitudinally extending ribs 49 adapted to bight into the inner faces of opening 42 for this purpose. The square contour of plug portion 46 provides for interengagement thereof with the inner surfaces of walls 30, 32 and 34 to prevent rotation of frame member 12 relative to the fastener plug and thus relative to frame member 10. Radial expansion of leg portions 46*a* and 46*b* in tubular portion 28 interengages frame members 10 and 12 against separation axially of frame members 12. Preferably, legs 46*a* and 46*b* are provided with transversely extending sharp ribs 60 adapted to bight into the inner surfaces of the walls of tubular portion 28 to enhance the interengagement therebetween against separation.

Preferably, webs 20 of channels 16 are each provided on the outer surfaces thereof between openings 42 with an extruded aluminum trim channel 62 having a web 64 and side flanges 66, which web and flanges define a panel edge receiving recess 68 to receive the corresponding marginal edge portion of panel A. Flanges 66 of each trim channel 62 are spaced apart a distance corresponding to the spacing between flanges 36 of frame members 12 and extend vertically between flanges 36 of frame members 12 so as to define a continuous peripheral panel edge receiving recess therewith. Preferably, the inner surfaces of flanges 66 of the trim channels are provided with longitudinally extending inwardly projecting ribs 70 similar to and for the same purpose as ribs 40 on flanges 36 of frame members 12.

The primary purpose of trim channels 62 is to provide continuity in appearance about the peripheral edge of panel A and to lend stability to the corresponding marginal edges of panel A against flexure perpendicular to the plane of the panel. This can be achieved simply by positioning the trim channels along the marginal edges of the panel but, preferably, the trim channels are interconnected with webs 20 of frame members 10 to maintain the trim channels in place against displacement inwardly of the frame assembly and against sliding movement in the plane of the outer surfaces of webs 20. Such interengagement can be simply achieved such as by means of a rivet 72 extending through apertures provided therefor in webs 64 and 20 and expanded adjacent the inner surface of web 20 to complete the interconnection.

Any suitable arrangement can be employed for fastening a completed panel assembly between supporting surfaces. In the embodiment shown, mounting brackets 14 are L-shaped members having a leg 74 overlying the outer surface of web 20 and a leg 76 extending inwardly of the frame assembly. Leg 74 is provided with an elongated slot 78, and web 20 is provided with an aperture 80, and bracket 14 is mounted on the corresponding frame member 10 by means of a headed bolt 82 which extends through slot 78 and aperture 80 to receive a nut 84. Slot 78 of course provides for adjusting bracket 14 longitudinally with respect to the corresponding frame member 10. Leg 76 of bracket 14 is provided with an elongated slot 86 by which the corresponding end of frame member 10 is adapted to be interconnected with a support surface by means of a suitable fastener, not shown. Slots 86 in the mounting brackets at corresponding ends of frame members 10 provide for adjustment of the panel and frame assembly in the direction of the plane thereof.

While L-shaped brackets 14 are shown mounted on the outer surfaces of webs 20 of channels 16, it will be appreciated that leg portions 74 of the brackets could be narrowed in the direction between flanges 22 of channels 16 so as to be positioned within the channels against the inner surfaces of webs 20 for interconnection therewith. Still further, flanges 22 of channels 16 can each be provided with a piar of longitudinally extending inwardly projecting ribs 88 providing the channel with opposed recesses 90 having a width slightly less than the thickness of a bracket leg such as leg 74 of bracket 14. The bracket leg would have a width providing for the opposite sides thereof to be received in recesses 90, and the bracket leg would be hammered or otherwise forced into the recess with the force fit therebetween providing the necessary interconnection. The extrusion of channel members 16 advantageously enables the provision of ribs 88 in the side frame members for this purpose and for the added mounting option provided thereby. Although the framed panel structure is illustrated and described in connection with brackets at the opposite ends of the side frame members for mounting the panel structure between opposed support surfaces, it will be appreciated that the structure can be otherwise mounted for use.

It will be appreciated that panel A to be supported by the frame assembly can be of any suitable structure and material. For example, the panel could be comprised of a body of relatively rigid synthetic resinous material provided on its opposite faces with a decorative embossed pattern, or facing sheets providing a desired decorative appearance. It will be further appreciated that the panel is of a thickness between the opposite sides thereof slightly greater than the spacing between the innermost edges of ribs 40 and 70 in the panel edge receiving recesses so that the panel is frictionally engaged against an undesirable amount of displacement relative to the frame assembly in the plane of the panel.

Fabrication of the frame components and the assembly thereof to produce the completed partition structure is procedurally simple. In this respect, channels 16 and cover plates 18 defining frame members 10 are extruded in indeterminate length and are cut to the desired length for a given frame structure. The necessary holes are then stamped in webs 20 of the channels to complete fabrication thereof. Frame members 12 are extruded in indeterminate length and are cut to the desired length for the given frame structure, and nothing further is required with regard to the fabrication of these members. Trim channels 67 are likewise extruded in indeterminate length and cut to the desired length for the frame structure, and the rivet holes are punched in the webs thereof.

Assembly of the frame components and panel A is readily achieved as follows. Trim channels 62 are riveted or otherwise attached to webs 20, anad corresponding ends of frame members 12 are then fastened to one of the channel members 16 by means of the expandable fasteners in the manner described hereinabove. Panel A is then slid into place for the corresponding marginal edges thereof to be received in recesses 38 of frame members 12 and recess 68 of the trim channel on the one channel member 16. The second channel member 16 is then positioned for the trim channel 62 thereon to receive the corresponding edge of panel A, and the second channel 16 is interconnected with frame members 12 by means of the expandable fasteners. If brackets 14 are employed as shown in FIG. 2, the brackets are then mounted on the channel webs, and the assembly operation is completed by snapping cover plates 18 in place to close the open sides of the channels. The completed panel structure is then ready for installation. Cover plates 18 advantageously cover and hide the fasteners and rigidify channels 16 against twisting and flexure.

In the event it becomes necessary or desirable to repair or replace a component of the assembly, cover plates 18 are readily removable to gain access to the outer ends of the expandable fasteners. Pins 56 of the fastener assemblies can be driven completely through the plug axially inwardly of tubular portion 28 of the corresponding frame member 12, thus to release the wedging action of the fastener legs on frame components 12. Frame members 10 and 12 can then be separated. It will be appreciated therefore, that maintenance, repair or replacement can readily achieved.

Of considerable importance in connection with the present invention is the fact that frame members 12 are of one piece construction whereby flanges 36 thereof are integral with the tubular portion. Frame members 12 are readily produced by extrusion and cut to the desired length. This is all that is necessary to produce the frame member in that, as extruded, the frame member includes the necessary openings for the expandable fasteners and a recess to receive the corresponding marginal edge of a panel. Moreover, by having the recess defining flanges integral with the tubular portion, the end cuts across the tubular portion and flanges are coplanar to assure a flush engagement between the ends of frame member 12 and the corresponding faces of webs 20 of channels 16. This increases the structural integrity of the frame assembly by minimizing the possibility of any relative pivotal displacement between the frame members 10 and 12 laterally of the axis of the expandable fasteners, assures alignment between the frame components, and lends to an overall pleasing appearance for the partition structure. While such a flush arrangement could be achieved by attaching a separate panel receiving channel to the tubular portion, similar to trim channel 62, and then cutting through the composite structure to achieve a coplanar relationship between the cut lines, the latter procedure not only involves the fabrication of two components and the fastening of the components together, but also involves material waste resulting from cutting the composite structure.

While the cross-sectional contour of the expandable fasteners and the openings therefor in channel web 20 and frame members 12 are herein illustrated and described as being square, it will be appreciated that the desired interengagement of the frame members against relative rotation can be achieved with fastener components and openings having polygonal cross-sections other than square. Further, it will be appreciated that expandable fastener structures other than the diagonally slotted structure shown can be employed. While it is preferred that the side frame members 10 be defined by U-shaped channels and cover plates snap-locked in place with respect thereto, it will be appreciated that other side frame member structures can be employed without departing from the principles of the present invention and that cover plates, when employed, can be removably interengaged with these frame members other than by snap-locked interengagement.

As many possible embodiments of the present invention can be made and as many possible changes can be made in the embodiment herein illustrated and described, it is to be distinctly understood that the foregoing descriptive matter is to be interpreted merely as illustrative of the present invention and not as a limitation.

What is claimed is:

1. A panel supporting frame assembly comprising, first and second pairs of parallel spaced apart frame members, said first pair of frame members having walls facing one another and provided with aligned polygonal openings therethrough, said second pair of frame members being extruded metal members having opposite ends juxtaposed with respect to said walls and provided with polygonal openings thereinto aligned with said openings through said walls, expandable fastener means extending through said openings in said walls and into the openings in the ends of said second pair of frame members, each of said second pair of frame members including a pair of longitudinally extending laterally spaced apart flanges integral therewith and defining a panel edge receiving recess therefor, said recesses of said second pair of frame members opening toward one another and being spaced apart to receive and support a panel therebetween, said fastener means having first portions in said wall openings, second portions in said second member openings and means engaging said walls to axially position said first and second portions in said openings, said first and second portions being of complementary polygonal cross-section and dimension with respect to the corresponding wall and second member openings, said second portion of each said fastener means including a plurality of legs in the corresponding second member opening, and each said fastener means further including wedge means engaging and spreading said legs radially against said corresponding second member opening.

2. The frame assembly according to claim 1, wherein each of said first pair of frame members has opposite ends, and means on said opposite ends for mounting said frame assembly between spaced apart support surfaces.

3. The frame assembly according to claim 1, wherein each of said first pair of frame members is a channel member having a web and parallel flanges, said channels having open sides facing away from one another, the webs of said channels defining said walls, and cover plate means closing said open sides of said channels.

4. The frame assembly according to claim 1, and a U-shaped member on the wall of each of said first pair of frame members, said U-shaped members opening toward one another and extending longitudinally of the corresponding frame member between said openings through the wall thereof, said U-shaped members and said flanges on said second pair of frame members defining opposed pairs of panel edge receiving recesses.

5. The frame assembly according to claim 1, wherein said pair of longitudinal flanges have opposed inner surfaces, and retention means on said inner surfaces and projecting inwardly thereof to engage the opposite sides of a panel edge received therebetween.

6. The frame assembly according to claim 5, wherein said retention means are longitudinally extending ribs integral with said flanges.

7. The frame assembly according to claim 1, wherein each of said pair of second frame members includes a tubular portion generally square in cross-section and having opposed pairs of sides having inner surfaces defining a square opening therethrough, said pair of longitudinally extending flanges projecting outwardly from said tubular portion perpendicular to a common one of said sides and parallel to the sides of said tubular portion adjacent said one side.

8. The frame assembly according to claim 7, wherein said longitudinally extending flanges have opposed inner surfaces, said inner surfaces including longitudinally extending ribs integral with said flanges and projecting inwardly from said surfaces to frictionally engage the opposite sides of a panel edge received between said flanges.

9. The frame assembly according to claim 8, wherein each of said first pair of frame members is a channel member having a web and parallel flanges, said channels having open sides facing away from one another, the webs of said channels defining said walls, and cover plate means closing said open sides of said channels.

10. The frame assembly according to claim 9, wherein said cover plate means and said flanges of said channels have interengaging means releaseably holding said cover plate means on said channels.

11. The frame assembly according to claim 10, and a U-shaped member on the wall of each of said first pair of frame members, said U-shaped members opening toward one another and extending longitudinally of the corresponding frame member between said openings through the wall thereof, said U-shaped members and said flanges on said second pair of frame members defining opposed pairs of panel edge receiving recesses.

12. The frame assembly according to claim 11, wherein each of said U-shaped members includes a bottom wall overlying and fastened to the wall of the corresponding one of said first pair of frame members and a pair of parallel side walls extending along the side edges of said bottom wall, said side walls having opposed inner surfaces including longitudinally extending ribs integral with said side walls and projecting inwardly from said opposed inner surfaces thereof.

13. The frame assembly according to claim 12, wherein each of said channel members defining said first pair of frame members has opposite ends, and bracket means attached to each channel member at the opposite ends thereof for mounting said frame between spaced apart support surfaces.

* * * * *